US010674838B2

(12) United States Patent
Lee et al.

(10) Patent No.: US 10,674,838 B2
(45) Date of Patent: Jun. 9, 2020

(54) REFRIGERATION SYSTEM AND DILUTION DEVICE FOR A MERCHANDISER

(71) Applicant: Hussmann Corporation, Bridgeton, MO (US)

(72) Inventors: Chiao M. Lee, St. Charles, MO (US); Doron Shapiro, St. Louis, MO (US); Sean Hanlon, O'Fallon, MO (US)

(73) Assignee: Hussmann Corporation, Bridgeton, MO (US)

( * ) Notice: Subject to any disclaimer, the term of this patent is extended or adjusted under 35 U.S.C. 154(b) by 921 days.

(21) Appl. No.: 14/247,641

(22) Filed: Apr. 8, 2014

(65) Prior Publication Data

US 2015/0282643 A1 Oct. 8, 2015

(51) Int. Cl.

| | |
|---|---|
| ***A47F 3/04*** | (2006.01) |
| ***F25B 49/00*** | (2006.01) |
| ***F25B 45/00*** | (2006.01) |

(52) U.S. Cl.

CPC ..... *A47F 3/0478* (2013.01); *A47F 3/0426* (2013.01); *F25B 45/00* (2013.01); *F25B 49/005* (2013.01); *F25B 2345/002* (2013.01); *F25B 2400/12* (2013.01)

(58) Field of Classification Search

CPC .... F25B 49/005; F25B 45/00; F25B 2400/12; F25B 2345/002; A47F 3/0478; A47F 3/0426

See application file for complete search history.

(56) References Cited

U.S. PATENT DOCUMENTS

| | | | | |
|---|---|---|---|---|
| 2,507,380 A * | 5/1950 | Morrison | F25B 45/00 | 220/88.3 |
| 3,386,261 A * | 6/1968 | Cornelius | B67D 1/0021 | 62/339 |
| 5,650,563 A * | 7/1997 | Cooper | G01M 3/228 | 73/40.7 |
| 5,718,119 A * | 2/1998 | Wakita | F25B 45/00 | 62/303 |
| 5,802,860 A | 9/1998 | Barrows | | |
| 6,056,162 A * | 5/2000 | Leighley | F16N 29/00 | 222/156 |
| 6,128,911 A * | 10/2000 | Mathews | A47F 3/0408 | 62/256 |
| 6,196,008 B1 * | 3/2001 | Fujitaka | F24F 1/0003 | 62/77 |

(Continued)

FOREIGN PATENT DOCUMENTS

| | | |
|---|---|---|
| EP | 1475588 | 11/2004 |
| JP | 2001174108 A * | 6/2001 |

*Primary Examiner* — Kun Kai Ma

(74) *Attorney, Agent, or Firm* — Michael Best & Friedrich LLP

(57) ABSTRACT

A refrigerated merchandiser including a case defining a product display area configured to support product, a refrigeration circuit in which a refrigerant circulates, and a dilution device coupled to the refrigeration circuit. The dilution device includes a valve assembly and a container supporting a pressurized fluid. The valve assembly is in fluid communication with the refrigeration circuit and is selectively variable to an open state to fluidly couple the container to the refrigeration circuit such that the fluid is discharged into the refrigeration circuit in response to a condition of the refrigeration circuit reaching or exceeding a predetermined threshold value.

20 Claims, 4 Drawing Sheets

(56) References Cited

U.S. PATENT DOCUMENTS 6,425,252 B1 * 7/2002 Kobayashi ..... F17C 13/002 62/292
7,127,902 B1 * 10/2006 Levy ..... B60H 1/00585 62/77
2005/0086952 A1 4/2005 Nonaka et al.
2005/0132728 A1 * 6/2005 Lifson ..... F25B 45/00 62/149
2005/0268642 A1 * 12/2005 Appler ..... B60H 1/00585 62/468
2006/0049329 A1 * 3/2006 Duerr ..... B60H 1/00585 250/200
2008/0209920 A1 * 9/2008 Mikheev ..... F25B 17/00 62/55.5
2009/0056353 A1 3/2009 Sunderland
2009/0133416 A1 5/2009 Swofford et al.
2009/0145143 A1 * 6/2009 McMasters ..... B60H 1/00585 62/149
2009/0183519 A1 7/2009 Nishikawa et al.
2009/0272131 A1 * 11/2009 McMasters ..... B60H 1/00585 62/77
2010/0107660 A1 * 5/2010 Kawano ..... F25B 45/00 62/77
2010/0300129 A1 12/2010 Bean, Jr. et al.
2011/0041523 A1 * 2/2011 Taras ..... F25B 9/008 62/77
2011/0167841 A1 * 7/2011 Appler ..... B60H 1/00585 62/77
2012/0023983 A1 2/2012 Giaros
2013/0025717 A1 * 1/2013 Leif ..... F25B 45/00 137/565.01
2013/0255294 A1 * 10/2013 Crawford ..... F25B 45/00 62/126
2014/0123691 A1 * 5/2014 Shapiro ..... F25B 49/022 62/115
2014/0182684 A1 * 7/2014 McMasters ..... F17D 1/08 137/1

* cited by examiner

REFRIGERATION SYSTEM AND DILUTION DEVICE FOR A MERCHANDISER

BACKGROUND

The present invention relates to a refrigeration system for a merchandiser and, more specifically, to a dilution system for a hydrocarbon refrigeration system.

Refrigerated merchandisers are used by grocers to store and display food items in a product display area that must be kept within a predetermined temperature range. These merchandisers generally include a case that is conditioned by a refrigeration system that has a compressor, a condenser, and at least one evaporator connected in series with each other. Typically, existing merchandisers use refrigerants such as R404a, R134a, or carbon dioxide.

Some refrigeration systems utilize hydrocarbon-based refrigerant (e.g., propane) that has a higher tendency to be flammable relative to conventional refrigerants. There are ways to reduce the risk of the ignition of a hydrocarbon-based refrigerant such as using intrinsically safe electrical components, and quality control to minimize any potential for leaks. However, a flammable mixture of refrigerant and air may exist inside the merchandiser and an ignition source such as a static electrical discharge may occur, causing the air and refrigerant mixture to ignite. When there is no path for the energy released by the ignition to escape, which is especially common in sealed cases, the excessive internal pressure may cause the case to explode.

SUMMARY

In one aspect, the invention provides a refrigerated merchandiser including a case that defines a product display area configured to support product and a refrigeration circuit at least partially disposed within the case. The refrigeration circuit includes a compressor configured to circulate a refrigerant through the refrigeration circuit and a dilution device coupled to the refrigeration circuit. The dilution device includes a valve assembly and a container supporting a pressurized fluid. The valve assembly is in fluid communication with the refrigeration circuit and selectively variable to an open state to fluidly couple the container to the refrigeration circuit such that the fluid is discharged into the refrigeration circuit in response to a condition of the refrigeration circuit exceeding a threshold value.

In another aspect, the invention provides a method of evacuating a refrigeration circuit of a merchandiser. The method includes charging the refrigeration circuit with a hydrocarbon refrigerant and conditioning a product display area of the merchandiser via heat exchange between refrigerant in the refrigeration circuit and a fluid in communication with the product display area. The method also includes detecting a pressure condition within the refrigeration circuit and discharging a pressurized fluid into the refrigeration circuit in response to the pressure condition exceeding a predetermined threshold value.

In another aspect, the invention provides a refrigerated merchandiser including a case defining a product display area and a refrigeration circuit at least partially disposed within the case. The refrigeration circuit includes a compressor configured to circulate a hydrocarbon refrigerant through the refrigeration circuit and a dilution device including a container supporting a fluid. The container is only fluidly coupled to the refrigeration circuit in response to a pressure differential between hydrocarbon refrigerant in the refrigeration circuit and the fluid supported in the container exceeding a predetermined threshold.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
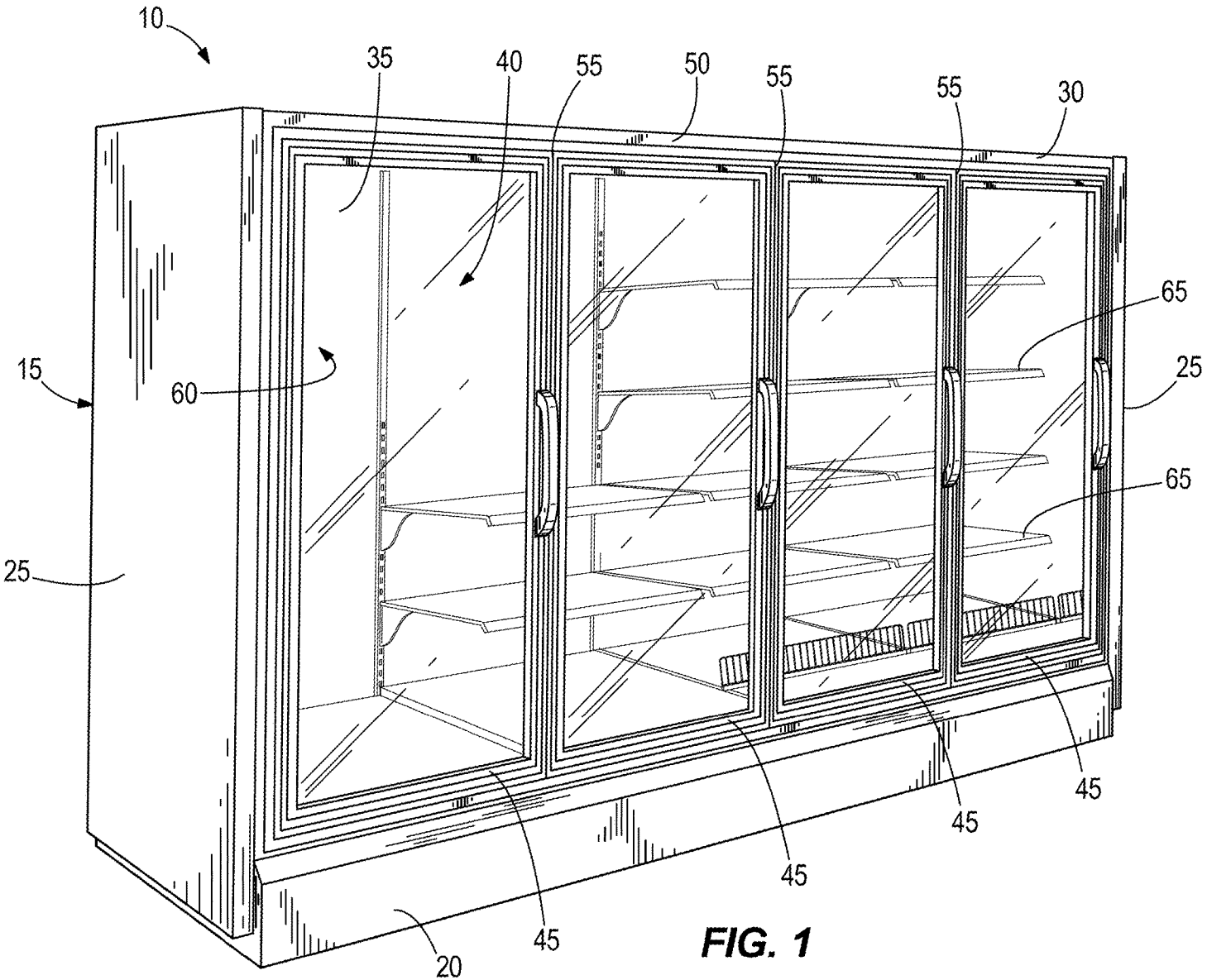
FIG. 1 is a perspective view of an exemplary refrigerated merchandiser embodying the invention.

FIG. 1 illustrates an exemplary refrigerated merchandiser 10 that may be located in a supermarket or a convenience store or other retail setting (not shown). The refrigerated merchandiser 10 includes a case 15 that has a base 20, opposite sidewalls 25, a canopy 30, and a rear wall 35. The area at least partially enclosed by the base 20, the sidewalls 25, the canopy 30, and the rear wall 35 defines a product display area 60 that supports product in the case 15 (e.g., on shelves 65).

Although the illustrated merchandiser 10 includes doors 45 that enclose the access opening 40, the merchandiser 10 can be an open-front merchandiser without doors. The doors 45 are mounted to a frame 50 that includes mullions 55 separating each of the doors 45. The doors 45 may be hinged or sliding doors. Also, the merchandiser 10 can be a vertical merchandiser, as illustrated in FIG. 1, or the merchandiser 10 can take other forms (e.g., a horizontally-oriented merchandiser), or be another type of structure (e.g., a storage room) including a conditioned product support area. In addition, the merchandiser 10 may be an open air merchandiser, a reach-in refrigerator, a floral merchandiser, a wine merchandiser, a dual service merchandiser, or any other known or future developed refrigerated merchandiser for use with a refrigeration system 70 as described in detail below.

Figure 2:
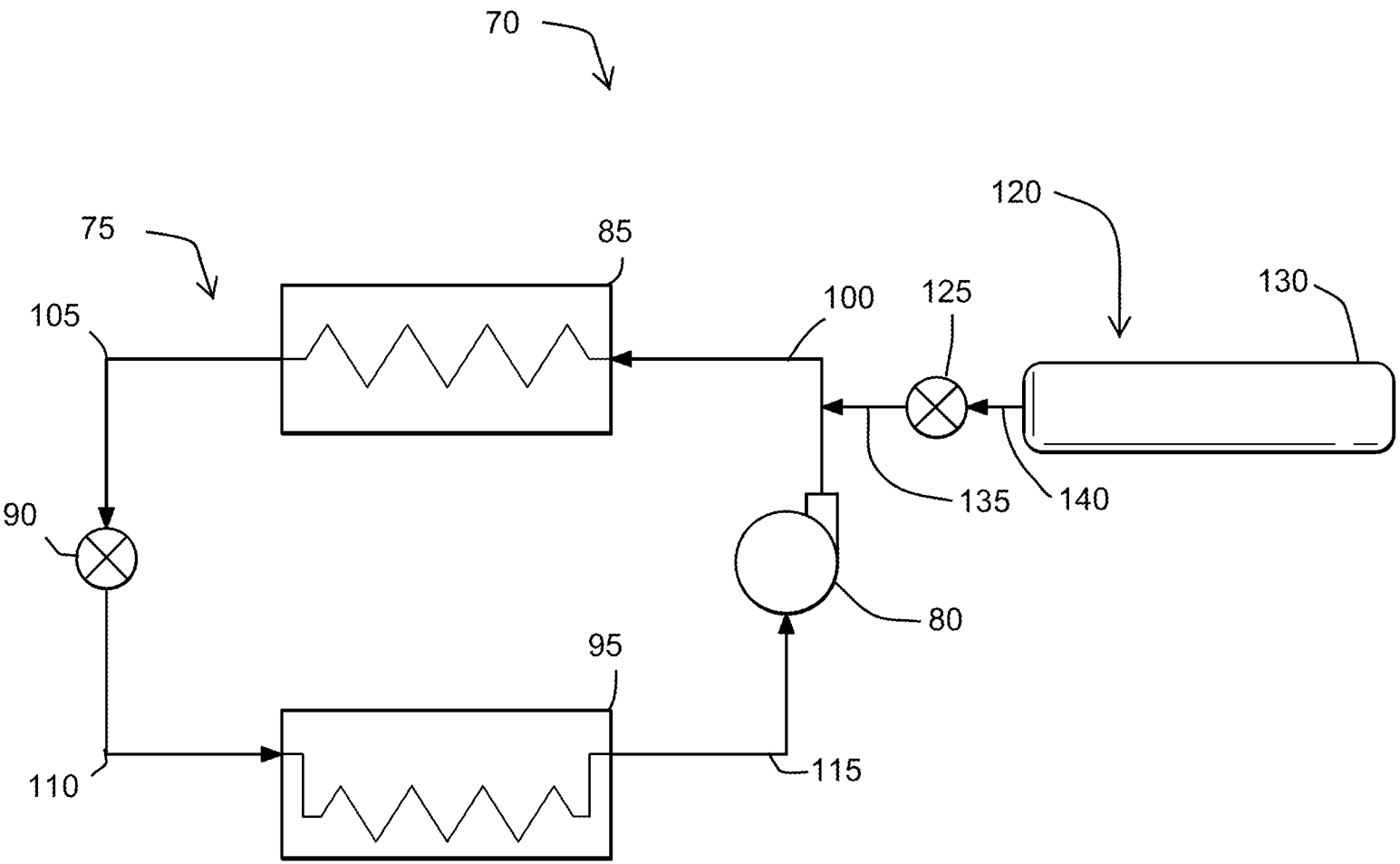
FIG. 2 is a schematic representation of a refrigeration circuit and a dilution device used in conjunction with the refrigerated merchandiser of FIG. 1.

FIG. 2 illustrates a refrigeration system 70 including a refrigeration circuit 75 that is at least partially disposed in the merchandiser 10 to refrigerate the product display area 60. The refrigeration circuit 75 has a compressor 80, a first heat exchanger or condenser 85 (referred to as a condenser for purposes of description only), an expansion valve 90, and a second heat exchanger or evaporator 95 (referred to as an evaporator for purposes of description only). The compressor 80 is fluidly coupled to the condenser 85 by a discharge line 100 and circulates a cooling fluid or refrigerant (described as "refrigerant" for purposes of description) such as a hydrocarbon refrigerant (e.g., propane) to condition the product display area 60. The charge of hydrocarbon refrigerant in each second circuit 75 does not exceed, for example, approximately 150 grams of hydrocarbon refrigerant (e.g., the refrigerant charge is at or below 150 grams), although in some constructions, the refrigerant charge may exceed 150 grams (e.g., based on the maximum charge established by government or safety regulations).

The condenser 85 is connected to the expansion valve 90 via a first fluid line 105, and the expansion valve 90 is connected to the evaporator 95 via a second fluid line 110. The evaporator 125 is connected to the compressor 110 via a suction line 115. While the system 70 of FIG. 1 is illustrated with the components and connections listed above, it is to be appreciated that additional or alternative components can be provided in the refrigeration system 70, and that the invention described herein may be used in any refrigeration system that may be used in conjunction with a refrigerated product display area 60.

With continued reference to FIG. 2, a dilution system is connected to the refrigeration circuit 75 to selectively flush refrigerant from the refrigeration circuit 75 when a predetermined condition of the merchandiser is detected. More specifically, the dilution system includes a dilution device 120 that has a valve assembly 125 and a container 130 supporting a pressurized gaseous fluid (e.g., carbon dioxide, nitrogen, xenon, krypton, nitrous oxide, sulfur hexafluoride, etc.). In general, the pressurized fluid includes an inert gas and differs from the cooling fluid or refrigerant that circulates through the circuit 75 during normal operation.

The valve assembly 125 can include a single valve or a plurality of valves and is fluidly coupled to the refrigeration circuit 75 through a first dilution line 135. The container 130 is fluidly connected to the valve assembly 125 opposite the fluid line 135 via a second dilution line 140. In one construction, the first dilution line 135 is coupled to the refrigeration circuit 75 between the compressor 80 and the condenser 85. As illustrated by dashed lines in FIG. 4, the dilution device 120 can be coupled to the circuit 75 at any other location, such as between the evaporator 95 and the compressor 80, or between the condenser 85 and the expansion valve 90. It will be appreciated that the refrigeration system 75 of FIG. 2 may also include the alternative or additional connection points for the dilution device 120.

Also, the dilution device 120 may be directly connected to the valve assembly 125, eliminating the second dilution line 140. In another construction, the valve assembly 125 can be part of the refrigeration circuit 75 (i.e. located within the refrigeration circuit 75) such that the refrigerant constantly flows through the valve assembly 125 during normal operation.

The illustrated valve assembly 125 includes at least one valve that is variable between an open state and a closed state based on a condition of the refrigeration system 70. The valve 125 is variable to the open state in response to the condition reaching or exceeding a predetermined threshold value, which may be brought upon by a refrigerant leak. The valve is maintained in the closed state during normal operation of the refrigeration system 70 (i.e. when the condition has not reached the threshold value). The condition may also be a result of any incident that would render it desirable to dilute the circuit 75 with the pressurized fluid.

Figure 3:
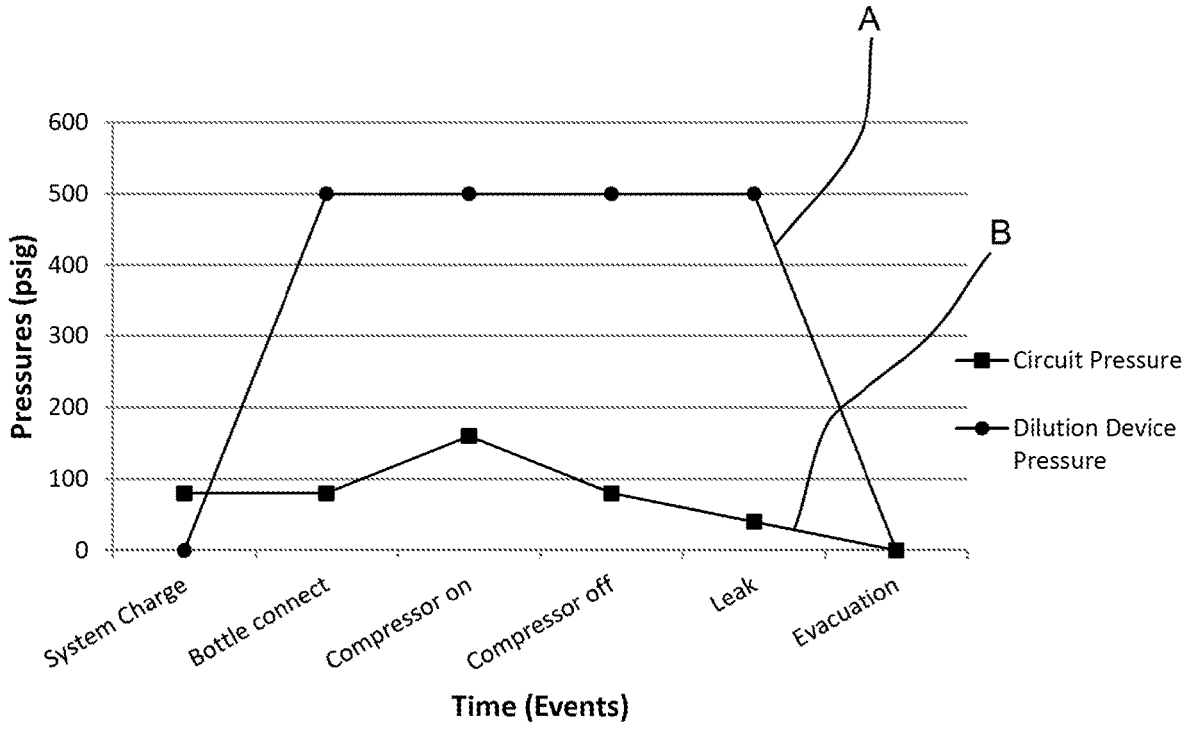
FIG. 3 is a graph illustrating system exemplary pressures within the dilution device and the refrigeration circuit.

For example, FIG. 3 illustrates one example of the condition of the circuit 75 as a pressure differential between the pressure in the refrigeration circuit 75 adjacent the connection to the valve assembly 125 and the pressure of the fluid in the container 130. In this example, the valve would vary to the open state when the pressure differential reaches or exceeds a predetermined pressure differential (e.g., approximately 460 psig). In another example, the condition may be a decrease or drop in pressure within the refrigeration circuit 75 below a threshold circuit pressure (e.g., approximately 40 psig) independent of the pressure of the fluid in the container 130. In general, the valve assembly 125 can automatically vary to the open state in response to reaching or exceeding the threshold value to release the pressurized fluid from within the container 130.

Figure 4:
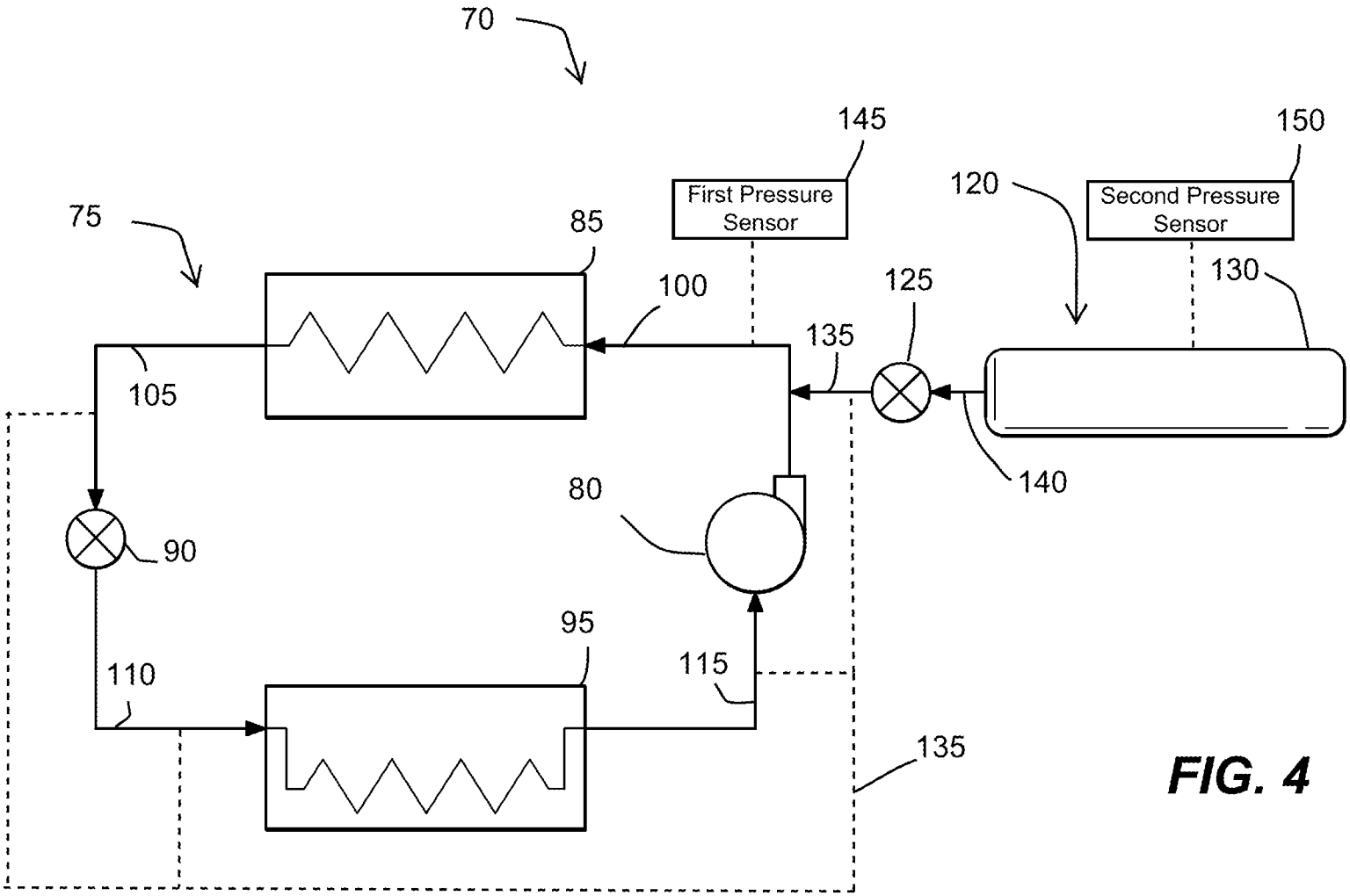
FIG. 4 is a schematic representation of the refrigeration circuit of FIG. 2 including sensors and different connection points for the dilution device.

FIG. 4 illustrates that the refrigeration system 70 also can include a first pressure sensor 145 and a second pressure sensor 150. The first pressure sensor 145 is in communication with the refrigeration circuit 75 (e.g., adjacent the connection to the dilution device 120) to sense the pressure of the circuit 75 (e.g., to detect refrigerant pooling or a refrigerant leak). The second pressure sensor 150 is in communication with the pressurized fluid in the container 125 to sense the pressure of the fluid (e.g., to ensure the fluid is maintained at a pressure adequate to dilute the refrigeration circuit 75, as described in detail below).

The pressures sensed by the sensors 145, 150 can be used separately or cooperatively to determine whether the valve assembly 125 should be adjusted to the open state. Also, while two pressure sensors 145, 150 are illustrated, the system 75 may include more or fewer than two pressure sensors. The pressures sensors 145, 150 may be used to determine whether there is a leak in the circuit 75 by comparing the sensed pressure value to normal or expected leak pressure values (or a range of values). The sensors 145, 150 can be used to solely control the state of the valve assembly 125, although the valve assembly 125 can be configured to open in response to 1) the condition of the circuit 75 reaching/exceeding the threshold value, or 2) data sensed by the sensors 145, 150 (e.g., to provide system redundancy). Although not shown, the sensors 145, 150 can be connected to a controller that selectively opens the valve assembly 125.

FIG. 3 illustrates operation of the refrigeration system 70 and the dilution system. More specifically, line A represents approximate pressures of the dilution device 120 at different stages of operation, and line B represents approximate pressures of the refrigeration circuit 75 at the same stages of operation. The following description includes values representative of only one example of the refrigeration system 70, and it will be appreciated that the approximate pressures, and relative pressure differentials, may be different depending on the design of the merchandiser 10, the refrigeration circuit 75, the dilution system, or any combination of these components. In the example described below, operation of the circuit 75 is simplified and the pressures for the refrigerant in the refrigeration circuit 75 refer to the pressure in the discharge line 100.

With reference to FIG. 3, when the system is first charged with refrigerant, the pressure of refrigerant in the refrigeration circuit 75 is approximately 80 psig. At this stage, the dilution device 120 has a pressure of 0 psig because the container 130 has not yet been pressurized or connected to the circuit 75. After the bottle or container 130 is pressurized and connected at the second stage, the pressure is approximately 500 psig. Upon startup of the refrigeration system 70, the compressor 80 is turned on and the pressure of the circuit 75 increases to approximately 160 psig. During normal operation, the pressure of the fluid in the container 130 remains substantially the same because the valve assembly 125 remains closed, although the container 130 may need to be re-pressurized periodically. When the compressor 80 is turned off (or in a non-operating state), the pressure of the circuit 75 returns to approximately 80 psig. During normal operation with the compressor 80 activated, a ratio defined by the fluid pressure relative to the refrigerant pressure is approximately 3.13, and the pressure differential is 340 psig. During normal operation with the compressor 80 deactivated, the ratio defined by the fluid pressure relative to the refrigerant pressure is approximately 6.25, and the pressure differential is 420 psig.

The ratios defined during normal operation are exemplary predetermined pressure differential threshold values that can be used to define when the valve to the open state. For example, the refrigerant pressure may drop to or below 40 psig in response to a leak in the circuit 75, or undesired pooling of refrigerant in a section of the circuit 75. At this lower pressure, the ratio defined by the fluid pressure relative to the refrigerant pressure increases to 12.5 (the pressure differential rises to 460 psig).

The dilution system is activated when the refrigerant pressure drops below a threshold value due to a refrigerant leak or pooling of refrigerant in a section of the circuit 75. That is, whenever the refrigerant pressure in the circuit 75 drops below 40 psig in this example, or the ratio or pressure differential increases beyond their respective values defined by the drop in pressure to or below 40 psig, the valve 125 responds by moving to the open state so that the pressurized fluid in the container 130 can evacuate and dilute the circuit 75. The pressure gradient between the pressurized fluid and the refrigerant pressure in the system 70 force the pressurized fluid into the circuit 70 when the valve 125 is opened. Also, the fluid released into the refrigeration circuit 75 can flow through the leak, if one exists, to dilute the refrigerant-air mixture so that the mixture of refrigerant and air is below a predetermined value (e.g., 25%) relative to the lower flammability limit of the mixture. FIG. 3 illustrates a leak in the refrigeration circuit 75, and after evacuation or dilution (or both), the refrigerant pressure and the fluid pressure in the container can approach or reach 0 psig.

In general, and as described above, the open state of the valve 125 can be triggered based solely upon the refrigerant pressure drop, or based on the pressure differential between the pressurized fluid and the refrigerant in the circuit 75 reaching or increasing beyond the predetermined threshold. Other factors may also be used to determine when the valve 125 is opened.

In the event of a refrigerant leak, the valve assembly 125 opens to permit the pressurized fluid contained in the container 130 to be released into the circuit 75. The pressurized fluid floods the refrigeration circuit 75 and dilutes the refrigerant. When the system 70 has a leak, the pressurized fluid also evacuates the circuit 75 to minimize the likelihood that a flammable condition can arise. In addition, the system 70 may automatically alert a user that a leak or refrigerant pooling has occurred so that further action may be taken. After the system 70 has been repaired or otherwise returned to a normal operational state, the refrigeration system can be recharged and the dilution system can be recharged for subsequent use.

The dilution system passively dilutes the refrigeration circuit 75 in response to an abnormal condition of the circuit 75 without the need for power. That is, the valve mechanically opens in response to a drop in refrigerant pressure (indicated by the drop in pressure or a significant change in the pressure differential, for example) to dilute the refrigerant in the circuit 75 using the built-in pressure gradient. In the event of a leak or pooling, the passive dilution system automatically releases a volume of pressurized gas into the refrigeration circuit 75 to minimize the risk that refrigerant could ignite.

Various features of the invention are set forth in the following claims.

The invention claimed is:

1. A refrigerated merchandiser comprising:

a case defining a product display area configured to support product;

a refrigeration circuit at least partially disposed within the case, the refrigeration circuit including a compressor configured to circulate a refrigerant through the refrigeration circuit; and a dilution device coupled to the refrigeration circuit and including a valve assembly and a container supporting a pressurized fluid having a composition that is different from a composition of the refrigerant, the valve assembly in fluid communication with the refrigeration circuit and selectively variable to an open state to fluidly couple the container to the refrigeration circuit such that the fluid is configured to be discharged into the refrigeration circuit to dilute the refrigerant and at least partially evacuate refrigerant from the refrigeration circuit in response to a condition of the refrigeration circuit exceeding a threshold value.

2. The refrigerated merchandiser of claim 1, wherein the condition includes a pressure differential between the dilution device and the refrigeration circuit.

3. The refrigerated merchandiser of claim 2, wherein the valve is movable to the open state in response to the pressure differential reaching or exceeding a threshold pressure differential value.

4. The refrigerated merchandiser of claim 2, further comprising a sensor coupled to at least one or both of the refrigeration circuit and the dilution device to detect the pressure differential.

5. The refrigerated merchandiser of claim 1, wherein the valve is movable to the open state in response to a drop in refrigerant pressure within the refrigeration circuit.

6. The refrigerated merchandiser of claim 1, wherein the refrigerant includes a hydrocarbon refrigerant.

7. The refrigerated merchandiser of claim 1, wherein the valve assembly is fluidly coupled to the refrigeration circuit via a fluid line in communication with a refrigerant line of the refrigeration system.

8. The refrigerated merchandiser of claim 1, wherein the refrigeration circuit further includes a first heat exchanger fluidly coupled to the compressor via a discharge line, an expansion valve fluidly coupled to the first heat exchanger via a fluid line, and a second heat exchanger located downstream of the expansion valve and fluidly coupled to the compressor via a suction line, and wherein the valve assembly is fluidly coupled to the refrigeration circuit at a location between the first heat exchanger and the expansion valve.

9. The refrigerated merchandiser of claim 1, wherein the refrigeration circuit further includes a first heat exchanger fluidly coupled to the compressor via a discharge line, an expansion valve fluidly coupled to the first heat exchanger via a fluid line, and a second heat exchanger located downstream of the expansion valve and fluidly coupled to the compressor via a suction line, and wherein the valve assembly is fluidly coupled to the refrigeration circuit at a location between the expansion valve and the second heat exchanger.

10. The refrigerated merchandiser of claim 1, wherein the refrigeration circuit further includes a first heat exchanger fluidly coupled to the compressor via a discharge line, an expansion valve fluidly coupled to the first heat exchanger via a fluid line, and a second heat exchanger located downstream of the expansion valve and fluidly coupled to the compressor via a suction line, and wherein the valve assembly is fluidly coupled to the refrigeration circuit at a location between the second heat exchanger and the compressor.

11. The refrigerated merchandiser of claim 1, wherein the refrigeration circuit further includes a first heat exchanger fluidly coupled to the compressor via a discharge line, an expansion valve fluidly coupled to the first heat exchanger via a fluid line, and a second heat exchanger located downstream of the expansion valve and fluidly coupled to the compressor via a suction line, and wherein the valve assembly is fluidly coupled to the refrigeration circuit at a location between the compressor and the first heat exchanger.

12. The refrigerated merchandiser of claim 1, wherein the fluid in the container includes an inert gas.

13. A method of evacuating a refrigeration circuit of a merchandiser, the method comprising:

charging the refrigeration circuit with a hydrocarbon refrigerant;

conditioning a product display area of the merchandiser via heat exchange between refrigerant in the refrigeration circuit and a fluid in communication with the product display area;

detecting a pressure condition within the refrigeration circuit; and discharging a pressurized fluid having a composition that is different from a composition of the refrigerant into the refrigeration circuit to dilute the refrigerant and at least partially evacuate refrigerant from the refrigeration circuit in response to the pressure condition exceeding a predetermined threshold value, wherein discharging the pressurized fluid includes a dilution device coupled to the refrigeration circuit and a valve assembly and a container supporting the pressurized fluid.

14. The method of claim 13, wherein detecting the pressure condition includes detecting a leak by sensing a pressure differential between refrigerant in the refrigeration circuit and the pressurized fluid, and comparing the pressure differential to a threshold pressure differential value.

15. The method of claim 14, further comprising fluidly connecting a container supporting the pressurized fluid to the refrigeration circuit via a valve assembly; and selectively opening the valve assembly in response to the pressure differential exceeding the threshold pressure differential value.

16. The method of claim 13, further comprising discharging pressurized fluid into the product display area through the leak.

17. A refrigerated merchandiser comprising:

a case defining a product display area;

a refrigeration circuit at least partially disposed within the case, the refrigeration circuit including a compressor configured to circulate a hydrocarbon refrigerant through the refrigeration circuit; and a dilution device including a container supporting a fluid including an inert gas, the container only fluidly coupled to the refrigeration circuit to dilute the hydrocarbon refrigerant in response to a pressure differential between hydrocarbon refrigerant in the refrigeration circuit and the fluid supported in the container exceeding a predetermined threshold.

18. The refrigerated merchandiser of claim 17, further comprising a valve positioned between the container and the refrigeration circuit to selectively fluidly couple the fluid in the container to the refrigeration circuit.

19. The refrigerated merchandiser of claim 17, wherein the container is selectively fluidly connected to the refrigeration circuit downstream of the compressor.

20. The refrigerated merchandiser of claim 17, wherein the fluid includes a pressurized gas.

* * * * *